US008565654B2

(12) United States Patent
Young et al.

(10) Patent No.: US 8,565,654 B2
(45) Date of Patent: Oct. 22, 2013

(54) ELECTROPHOTOGRAPHIC PRINTER TRANSFER STATION WITH SKI

(75) Inventors: Timothy John Young, Williamson, NY (US); Andrew Peter Kittleson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 164 days.

(21) Appl. No.: 13/188,537

(22) Filed: Jul. 22, 2011

(65) Prior Publication Data

US 2013/0022379 A1 Jan. 24, 2013

(51) Int. Cl.
*G03G 15/16* (2006.01)

(52) U.S. Cl.
USPC ..... 399/312; 399/318

(58) Field of Classification Search
USPC ..... 399/312
See application file for complete search history.

(56) References Cited

U.S. PATENT DOCUMENTS

| | | | | |
|---|---|---|---|---|
| 3,848,992 | A * | 11/1974 | Smith | 399/350 |
| 5,040,026 | A | 8/1991 | Jamzadeh | |
| 5,697,030 | A * | 12/1997 | Hayashi et al. | 399/299 |
| 6,608,641 | B1 | 8/2003 | Alexandrovich et al. | |
| 2002/0168200 | A1 | 11/2002 | Stelter et al. | |
| 2006/0133870 | A1 | 6/2006 | Ng | |
| 2007/0059054 | A1 * | 3/2007 | Furukawa | 399/302 |
| 2007/0196142 | A1 * | 8/2007 | Kaiho | 399/302 |
| 2010/0239334 | A1 * | 9/2010 | Iwami et al. | 399/313 |

* cited by examiner

*Primary Examiner* — Clayton E LaBalle
*Assistant Examiner* — Jas Sanghera
(74) *Attorney, Agent, or Firm* — Christopher J. White; Raymond L. Owens

(57) ABSTRACT

A transfer station is described for an EP printer that transfers a toner image to a receiver sheet carried on a rotatable transport web. The web is wrapped around a rotatable image-bearing member to define a transfer region. A nip-forming ski adjacent to the transport web on the opposite side thereof from the image-bearing member extends upstream of the transfer region. A ski mount causes the ski to press the transport web towards the image-bearing member. Therefore, as the receiver sheet moves with the transport web, the receiver sheet engages the image-bearing member upstream of the transfer region, causing the transport web to push against the ski to provide a selected nip-spacing between the image-bearing member and the transport web in the transfer region.

12 Claims, 6 Drawing Sheets

ELECTROPHOTOGRAPHIC PRINTER TRANSFER STATION WITH SKI

FIELD OF THE INVENTION

This invention pertains to the field of printing and more particularly to improving image quality of various types of printed images.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects.

Printers typically operate using subtractive color: a substantially reflective receiver is overcoated image-wise with separations of cyan (C), magenta (M), yellow (Y), black (K), and other colorants, one at a time.

In various printers, receiver sheets are transported by a transport web through a plurality of printing modules. Each printing module deposits a single separation on the receiver. In such printers, several receiver sheets are typically present on the transport web or belt simultaneously. For example, a five-station printer can transport five sheets on the web simultaneously, with one sheet being printed in each module at any given time. More or fewer sheets can be accommodated on the web simultaneously depending on the spacing between printing modules and the speed of the web.

SUMMARY OF THE INVENTION

However, when multiple print modules are printing on one or more receivers simultaneously, mechanical disturbances from one printing module can produce image artifacts in other modules. FIGS. 3A-3D show an example of this problem as it occurs in one printing module. These figures show the entrance of receiver 42 on transport web 81 into transfer nip 310 as described in prior systems. Transfer nip 310 is formed between an image-bearing member 320 (which can be intermediate transfer component 112 or photoreceptor 206, FIG. 2) and a rotatable nip-forming member 383 (which can be transfer backup component 113, FIG. 2). FIG. 3A shows these components before the receiver reaches transfer nip 310.

FIG. 3B shows receiver 42 beginning to engage image-bearing member 320. FIG. 3C shows receiver 42 having engaged image-bearing member 320, and about to enter transfer nip 310. It has been determined that, as shown, transport web 81 is buckled at point 381 because of the thickness 342 of receiver 42.

FIG. 3D shows receiver 42 having entered transfer nip 310. Nip-forming member 383 has been displaced by displacement 311 to permit receiver 42 with thickness 342 to enter transfer nip 310.

It has been determined that the buckle at point 381 (FIG. 3C) and the displacement of nip-forming member 383 (FIG. 3D) produce mechanical waves (shock waves) that propagate along transport web 81. These shock waves can cause visible image artifacts on prints in other nips. For example, referring to FIG. 1, shock waves caused when receiver 42 enters the transfer nip of printing module 32 can cause image artifacts on receivers in printing modules 31 or 33 when the shock waves reach the transfer nips thereof.

Various schemes have been suggested to solve this problem. For example, the nip can be actively opened before the sheet reaches it and then closed to engage the sheet. However, this scheme increases the difficulty of producing borderless prints since the top of the sheet is not firmly engaged in the nip as the nip closes. Moreover, this scheme cannot be used in friction-drive systems in which the transport web provides the motive power for the other rotating components of the printer. There is a continuing need, therefore, for a way of reducing the power of shock waves that can cause image artifacts.

Various aspects of the present invention are useful, for example, with printers in which a web is at least partially wrapped around a rotatable image-bearing member. In a first aspect, a nip-forming ski is caused to press the transport web towards the image-bearing member. In a second aspect, a rotatable nip-forming member moves with a ski and is caused to press the transport web towards the image-bearing member.

Various aspects of the present invention are useful, for example, with printers in which a web is spaced apart from a rotatable image-bearing member. In a third aspect, a nip-forming ski is caused to apply a force not less than zero newtons on the transport web towards the image-bearing member. In a fourth aspect, a rotatable nip-forming member moves with a ski and is caused to exert a force not less than zero newtons on the transport web towards the image-bearing member.

According to a first aspect of the present invention, there is provided a transfer station for an EP printer adapted to transfer a toner image to a receiver sheet being carried on a rotatable transport web, the transfer station comprising:

a) the rotatable transport web;

b) a rotatable image-bearing member around which the transport web is at least partially wrapped, so that a transfer region is defined in which toner is transferred from the image-bearing member to the receiver sheet c) a nip-forming ski adjacent to the transport web on the opposite side thereof from the image-bearing member and extending upstream of the transfer region; and d) a ski mount arranged to cause the ski to press the transport web towards the image-bearing member;

e) so that as the receiver sheet moves with the transport web, the receiver sheet engages the image-bearing member upstream of the transfer region, causing the transport web to push against the ski to provide a selected nip spacing between the image-bearing member and the transport web in the transfer region.

According to a second aspect of the present invention, there is provided a transfer station for an EP printer adapted to transfer a toner image to a receiver sheet being carried on a rotatable transport web, the transfer station comprising:

a) the rotatable transport web;

b) a rotatable image-bearing member around which the transport web is at least partially wrapped, so that a transfer region is defined in which toner is transferred from the image-bearing member to the receiver sheet;

c) a rotatable nip-forming member adjacent to the transport web on the opposite side thereof from the image-bearing member;

d) a ski adjacent to the transport web on the opposite side thereof from the image-bearing member and extending upstream of the transfer region; and e) a mount arranged to cause the nip-forming member to press the transport web towards the image-bearing member, wherein the ski is connected to the nip-forming member or the mount so that the nip-forming member moves with the ski;

f) so that as the receiver sheet moves with the transport web, the receiver sheet engages the image-bearing member upstream of the transfer region, causing the transport web to push against the ski to move the nip-forming member to provide a selected nip spacing between the image-bearing member and the transport web in the transfer region.

According to a third aspect of the present invention, there is provided a transfer station for an EP printer adapted to transfer a toner image to a receiver sheet being carried on a rotatable transport web, the transfer station comprising:

a) the rotatable transport web;

b) a rotatable image-bearing member spaced apart from the transport web, so that a transfer region is defined in which toner is transferred from the image-bearing member to the receiver sheet c) a nip-forming ski adjacent to the transport web on the opposite side thereof from the image-bearing member and extending upstream of the transfer region; and d) a ski mount arranged to cause the ski to apply a force not less than zero newtons on the transport web towards the image-bearing member;

e) so that as the receiver sheet moves with the transport web, the receiver sheet engages the image-bearing member upstream of the transfer region, causing the transport web to push against the ski to provide a selected nip spacing between the image-bearing member and the transport web in the transfer region.

According to a fourth aspect of the present invention, there is provided a transfer station for an EP printer adapted to transfer a toner image to a receiver sheet being carried on a rotatable transport web, the transfer station comprising:

a) the rotatable transport web;

b) a rotatable image-bearing member spaced apart from the transport web, so that a transfer region is defined in which toner is transferred from the image-bearing member to the receiver sheet;

c) a rotatable nip-forming member adjacent to the transport web on the opposite side thereof from the image-bearing member;

d) a ski adjacent to the transport web on the opposite side thereof from the image-bearing member and extending upstream of the transfer region; and e) a mount arranged to cause the nip-forming member to exert a force not less than zero newtons on the transport web towards the image-bearing member, wherein the ski is connected to the nip-forming member or the mount so that the nip-forming member moves with the ski;

f) so that as the receiver sheet moves with the transport web, the receiver sheet engages the image-bearing member upstream of the transfer region, causing the transport web to push against the ski to move the nip-forming member to provide a selected nip spacing between the image-bearing member and the transport web in the transfer region.

An advantage of this invention is that it reduces the magnitude of shock waves that can cause image artifacts. Various embodiments using a nip-forming ski do not require a rotating nip-forming member, reducing the complexity of hardware at the transfer nip. Some of these embodiments use fewer components than roller systems. Some of these embodiments provide continuous contact between the transport web and the ski as the receiver sheet travels through the transfer nip. This can further reduce sharp motions of the ski toward or away from the image-bearing member and the resulting shock waves, so it can further reduce image artifacts. Various embodiments use a ski that is shaped to tailor the motion of the receiver or the configuration of the transfer region. Various embodiments provide ski shapes that improve paper release when the paper exits the transfer nip, separately control pre-nip and post nip wrap, or control pressure distribution in the transfer nip. These shapes provide the advantages of systems using many small rollers, but without requiring many moving parts.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
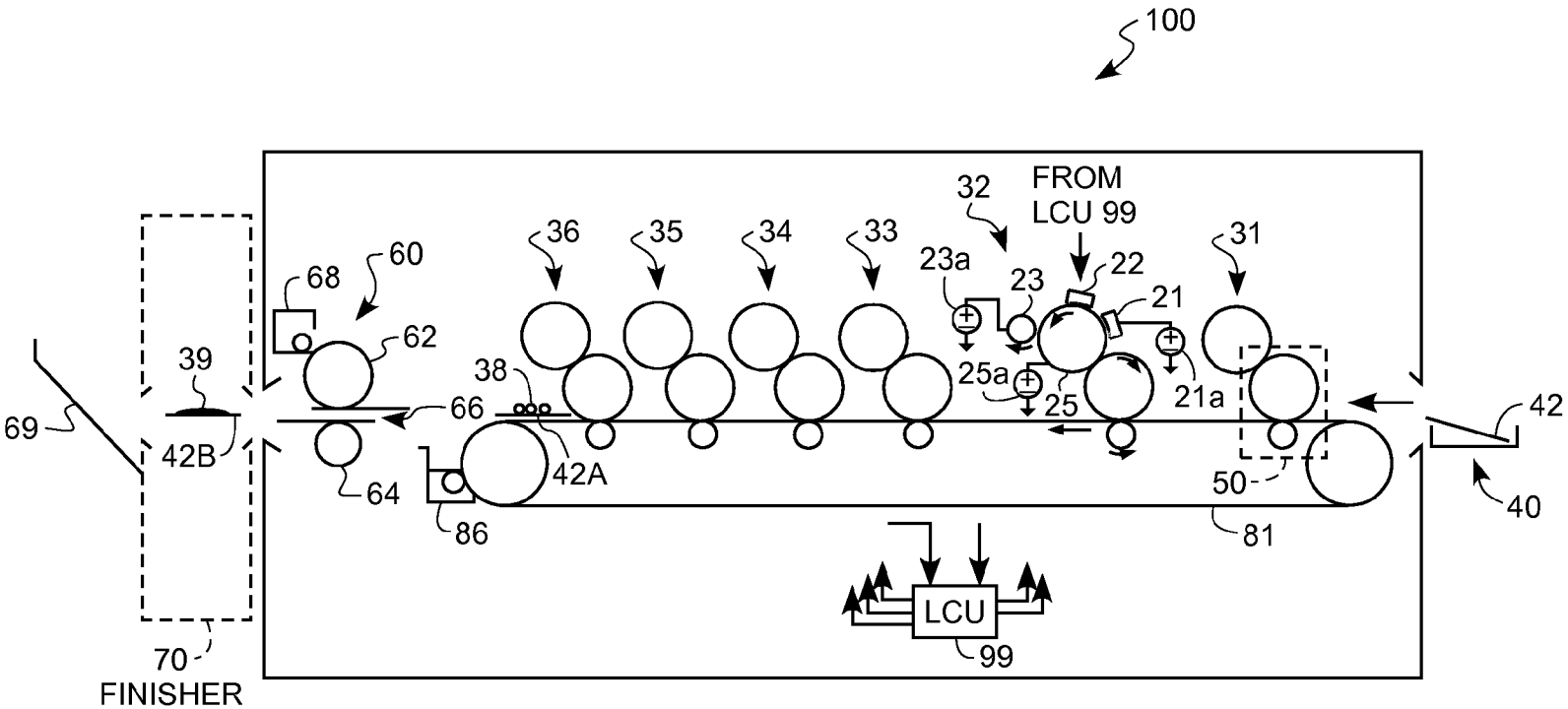
FIG. 1 is an elevational cross-section of an electrophotographic reproduction apparatus.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with various embodiments, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100 useful with various embodiments. Printer 100 is adapted to produce print images, such as single-color (monochrome), CMYK, or hexachrome (six-color) images on a receiver (multicolor images are also known as "multi-component" images). Images can include text, graphics, photos, and other types of visual content. One embodiment involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including webs.

Referring to FIG. 1, printer 100 is an electrophotographic printing apparatus having a number of tandemly-arranged electrophotographic image-bearing printing modules 31, 32, 33, 34, 35, 36, also known as electrophotographic imaging subsystems. Each printing module 31, 32, 33, 34, 35 36 produces a single-color toner image for transfer using a respective transfer subsystem 50 (for clarity, only one is labeled) to a receiver 42 successively moved through the printing modules 31, 32, 33, 34, 35, 36. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or web(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form the desired print image 38 on the receiver, as shown on receiver 42A. The imaging process is typically repeated many times with reusable photoreceptors 25.

Receiver 42A is then removed from its operative association with photoreceptor 25 and subjected to heat or pressure to permanently fix ("fuse") print image 38 to receiver 42A. Plural print images, e.g. of separations of different colors, are overlaid on one receiver 42 before fusing to form a multicolor print image 38 on receiver 42A.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images, overlaid in registration, one from each of the respective printing modules 31, 32, 33, 34, 35, 36, receiver 42A is advanced to a fuser 60, i.e. a fusing or fixing assembly, to fuse print image 38 to receiver 42A. Transport web 81 transports the print-image-carrying receivers 42A to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with various embodiments. For example, solvent fixing uses solvents to soften the toner particles so they bond with the receiver 42A. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42A.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers 42A. This permits printer 100 to print on receivers 42A of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 2:
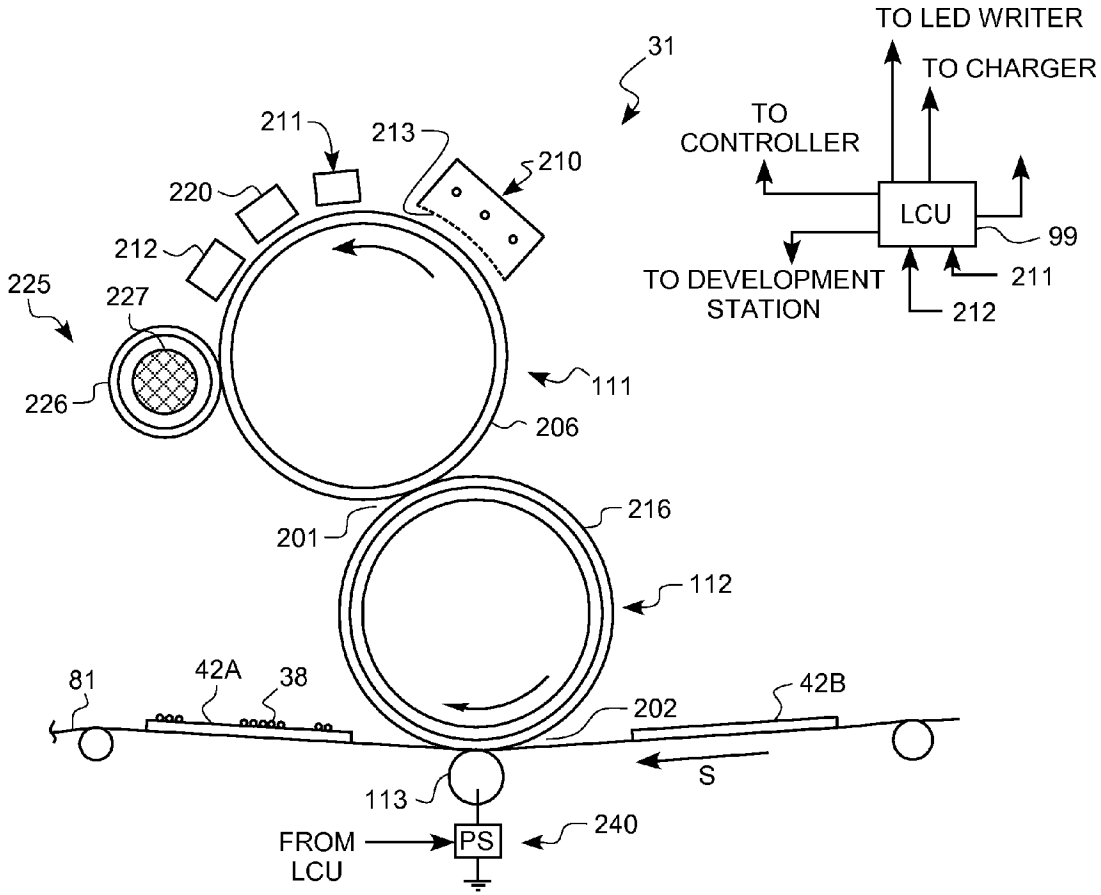
FIG. 2 shows more details of a printing module according to various embodiments.
Figure 3A:
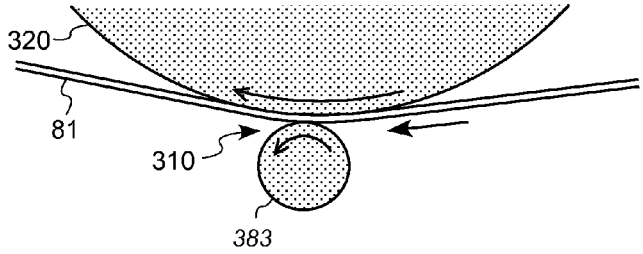
FIG. 3A (PRIOR ART)
FIGS. 3A-3B show the entrance of receiver 42 on transport web 81 into transfer nip 310 as described in prior schemes.
Figure 3B:
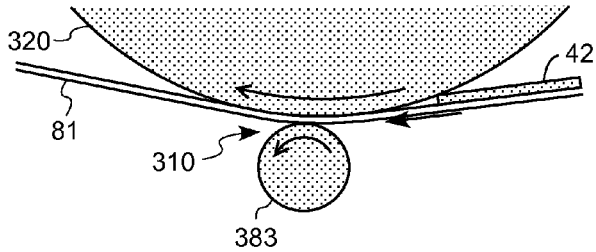
FIG. 3B (PRIOR ART)
Figure 3C:
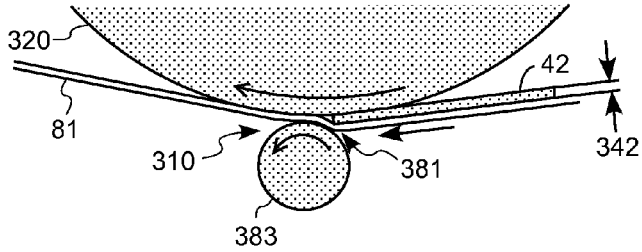
FIGS. 3C-3D show effects of the entrance of receiver 42 on transport web 81 into transfer nip 310.
Figure 3D:
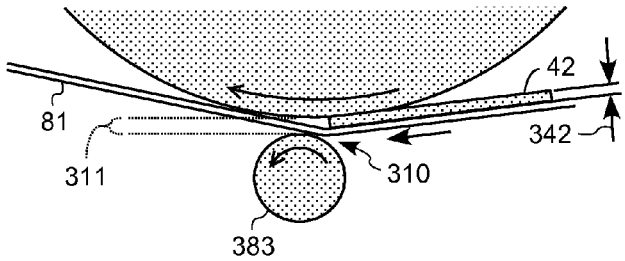

FIG. 2 shows more details of printing module 31, which is representative of printing modules 32, 33, 34, 35, and 36 (FIG. 1). Primary charging subsystem 210 uniformly electrostatically charges photoreceptor 206 of imaging component 111, shown in the form of an imaging cylinder. Charging subsystem 210 includes a grid 213 having a selected voltage. Meter 211 measures the uniform electrostatic charge provided by charging subsystem 210, and meter 212 measures the post-exposure surface potential within a patch area of a latent image formed from time to time in a non-image area on photoreceptor 206. LCU 99 sends control signals to the charging subsystem 210, the exposure subsystem 220 (e.g., laser or LED writers), and the respective development station 225 of each printing module 31, 32, 33, 34, 35 (FIG. 1)

Imaging component 111 includes photoreceptor 206. Photoreceptor 206 includes a photoconductive layer formed on an electrically conductive substrate. An exposure subsystem 220 is provided for image-wise modulating the uniform electrostatic charge on photoreceptor 206 by exposing photoreceptor 206 to electromagnetic radiation to form a latent electrostatic image.

Development station 225 includes toning shell 226 for applying toner of a selected color to the latent image on photoreceptor 206 to produce a visible image on photoreceptor 206. Development station 225 is electrically biased by a suitable respective voltage to develop the respective latent image. Developer is provided to toning shell 226 by a supply system (not shown). Toner is transferred by electrostatic forces from development station 225 to photoreceptor 206.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Further details of magnetic core 227 can be found in U.S. Pat. No. 7,120,379 to Eck et al., issued Oct. 10, 2006, and in U.S. Publication No. 20020168200 by Stelter et al., published Nov. 14, 2002, the disclosures of which are incorporated herein by reference.

Transfer subsystem 50 (FIG. 1) includes transfer backup component 113 and intermediate transfer component 112 for transferring the respective print image from photoreceptor 206 of imaging component 111 through a first transfer nip 201 to surface 216 of intermediate transfer component 112, and thence to a receiver (e.g., 42B) which receives the respective toned print images 38 from each printing module 31, 32, 33, 34, 35, 36 in superposition to form a composite image thereon. Print image 38 is e.g., a separation of one color, such as cyan. Receivers 42 are transported by transport web 81. Transfer to a receiver 42 is effected by an electrical field provided to transfer backup component 113 by power source 240, which is controlled by LCU 99. Receivers 42 can be any objects or surfaces onto which toner can be transferred from imaging component 111 by application of the electric field. In this example, receiver 42B is shown prior to entry into second transfer nip 202, and receiver 42A is shown subsequent to transfer of the print image 38 onto receiver 42A.

Figure 4A:
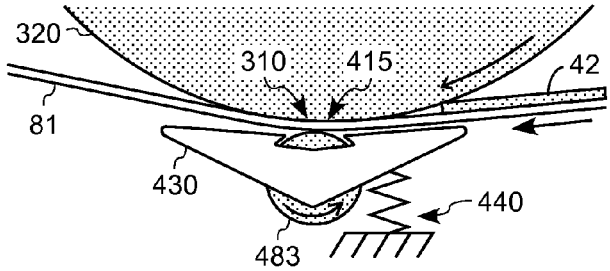
FIGS. 4A-4C show the entrance of receiver 42 on transport web 81 into transfer nip 310 according to various embodiments.
Figure 4B:
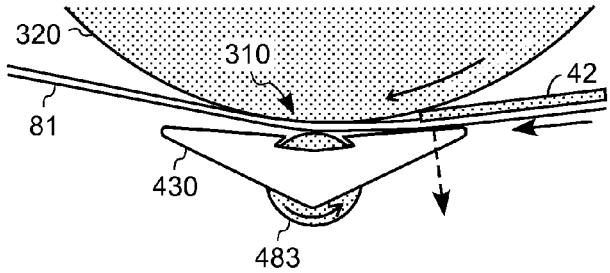
Figure 4C:
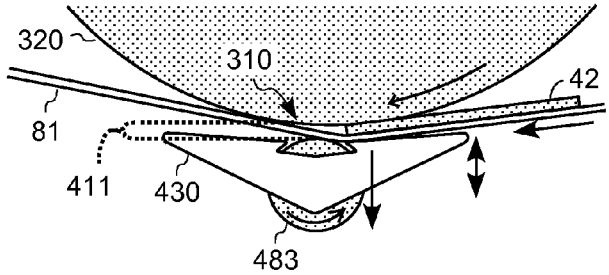

FIGS. 4A-4C show the entrance of receiver 42 on transport web 81 into transfer nip 310 according to various embodiments. Shown are parts of a transfer station for an EP printer adapted to transfer a toner image to a receiver sheet 42 being carried on a rotatable transport web 81. Image-bearing member 320, transfer nip 310, and transport web 81 are as described in FIGS. 3A-3D. The structure shown will be described, then its function.

Referring to FIG. 4A, transport web 81 is at least partially wrapped, whether or not entrained, around image-bearing member 320, so that transfer region 415 is defined in which toner is transferred from image-bearing member 320 to receiver sheet 42. Rotating nip-forming member 483 is a roller or a web entrained around a drive roller. Nip-forming member 483 is arranged adjacent to transport web 81 on the opposite side thereof from image-bearing member 320.

Ski 430 is adjacent to transport web 81 on the opposite side thereof from image-bearing member 320. Ski 430 extends upstream (with respect to transport web 81) of transfer region 415.

Mount 440 is arranged to cause nip-forming member 483 to press transport web 81 towards image-bearing member 320. Ski 430 is connected to nip-forming member 483 or mount 440 so that nip-forming member 483 moves with ski 430. This permits ski 430 to draw nip-forming member 483 away from image-bearing member 320, as will be described below. In the example shown, mount 440 and nip-forming member 483 are both connected to ski 430, and mount 440 includes a spring; other configurations can be used.

FIG. 4A shows receiver sheet 42 engaging image-bearing member 320 as receiver sheet 42 is moved by transport web 81. In this example, ski 430 is not in contact with transport web 81.

As shown in FIG. 4B, as sheet 42 continues to move, it rides down the circumference of image-bearing member 320. Image-bearing member 320 pushes on receiver sheet 42, which in turn pushes on transport web 81, which pushes on ski 430. This is shown by the dashed arrow. When ski 430 is pushed down, nip-forming member 483 is pushed down with it. In FIG. 4B, transport web 81 has just made contact with ski 430 and is about to push it down.

In FIG. 4C, receiver sheet 42 has advanced and is just about to enter transfer nip 310. Transport web 81 has pushed down ski 430 and thus nip-forming member 483 has been pushed down to open transfer nip 310. Transfer nip 310 has opened to a nip spacing 411. Unlike FIG. 3C, no buckle of transport web 81 is present. This reduces the amplitude of any mechanical waves (shock waves) formed, and thus reduces image artifacts due to those waves.

In summary, as receiver sheet 42 moves with transport web 81, receiver sheet 42 engages image-bearing member 320 upstream of transfer region 415 (FIG. 4A). This causes transport web 81 to push against ski 430 to move nip-forming member 483 (FIG. 4B). As a result, selected nip spacing 411 is provided between image-bearing member 320 and transport web 81 in transfer region 415 (FIG. 4C). "Nip spacing" is the separation of the two surfaces between which receiver 42 will pass in transfer nip 310, at the point of closest approach between those surfaces. In various embodiments, transport web 81 is one of those surfaces. An example of such an embodiment is shown in FIG. 4C, in which receiver 42 is pressing transport web 81 away from image-bearing member 320. Nip spacing 411 can be increased by moving nip-forming member 483 (e.g., using ski 430) away from image-bearing member 320, instead of by directly moving transport web 81 away from image-bearing member 320.

In various embodiments, transport web 81 is between 2.5 mils and 7 mils thick. Thicker webs can also be used. Receiver sheet 42 can be between 2 mils and 20 mils thick, or up to 100 mils thick, or thicker.

Figure 5:
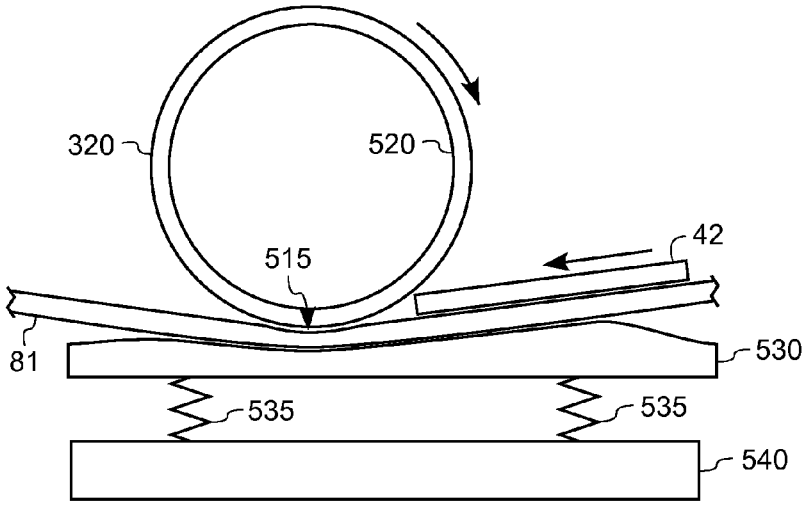
FIGS. 5-8 show portions of transfer stations according to various embodiments.

FIG. 5 shows a transfer station according to various embodiments. The transfer station is adapted to transfer a toner image to a receiver sheet being carried on a rotatable transport web. Rotatable transport web 81 is as shown in FIG. 1 and is at least partially wrapped around rotatable image-bearing member 320. Transport web 81 can be entrained around image-bearing member 320 or not. This defines transfer region 515 in which toner is transferred from image-bearing member 320 to receiver sheet 42. Image-bearing member 320 forms a transfer nip with nip-forming ski 530; the nip can be larger or smaller than transfer region 515.

Nip-forming ski 530 is a non-rotating member that forms a nip with a rotating member, here image-bearing member 320.

Nip-forming ski 530 is adjacent to transport web 81 on the opposite side thereof from image-bearing member 320. Nip-forming ski 530 extends upstream (with respect to transport web 81) of transfer region 515. Nip-forming ski 530 can include one or more shafts or rods, one or more bars extending in the cross-track direction, or a flat or curved plate (shown here). The ski can have a profiled surface to provide desired properties in transfer region 515, as discussed below, e.g., with reference to FIG. 7. Ski mount 540 is arranged to cause nip-forming ski 530 to press transport web 81 towards image-bearing member 320. In the example shown, nip-forming ski 530 is spring-mounted to ski mount 540 by springs 535. Nip-forming ski 530 can be mounted so that it is always parallel to ski mount 540, or not. The surface of nip-forming ski 530 can be shaped to cooperate with springs 535 to provide a selected pressure against the image-bearing member 320 at selected points in the passage of receiver sheet 42 through transfer region 515. Nip-forming ski 530 can be fixed or movable. With movable skis 530, a structure for providing a force to image-bearing member 320 is used (in the example shown, springs 535 and ski mount 540). This structure can include springs, air cylinders, or weights and pulleys.

As receiver sheet 42 moves with transport web 81, receiver sheet 42 engages image-bearing member 320 upstream of transfer region 515. This causes transport web 81 to push against nip-forming ski 530. Nip-forming ski 530 moves in response to provide a selected nip spacing between image-bearing member 320 and transport web 81 in transfer region 515.

In various embodiments, image-bearing member 320 has a compliant surface of at most 80 Shore A durometer. In some of these embodiments, image-bearing member 320 includes compliant layer 520. In other embodiments, image-bearing member 320 is formed of a compliant material.

In various embodiments, when receiver sheet 42 is not engaged with image-bearing member 320, nip-forming ski 530 is not in mechanical contact with transport web 81. In other embodiments, nip-forming ski 530 is in mechanical contact with transport web 81 the majority of the time, including at various times when receiver sheet 42 is not engaged with image-bearing member 320. In these embodiments, nip-forming ski 530 can assist in maintaining the wrap of transport web 81 around image-bearing member 320.

In various embodiments, nip-forming ski 530 is shaped to improve paper release when the paper exits the transfer nip, separately control pre-nip and post nip wrap, or control pressure distribution in the transfer nip. In various embodiments, nip-forming ski 530 has a substantially non-circular or non-arcuate cross section, or a cross section that is not composed of substantially circular or arcuate segments. This provides more flexibility in controlling the transfer nip geometry than using multiple rollers of various diameters. Various examples of providing specific characteristics in transfer region 515 are discussed below.

Figure 6:
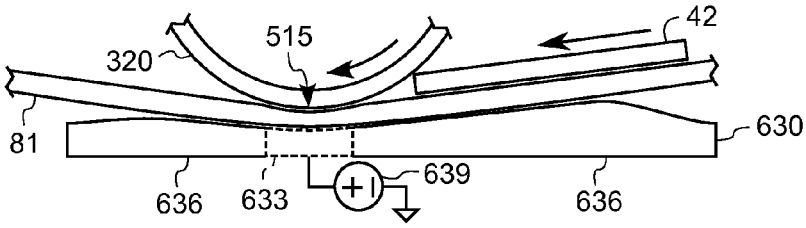

FIG. 6 shows portions of a transfer station according to various embodiments. Image-bearing member 320, transport web 81, receiver sheet 42, and transfer region 515 are as shown in FIG. 5. Nip-forming ski 630 includes conductive area 633 in transfer region 515 and non-conductive area 636 outside transfer region 515. That is, conductive area 633 forms all or part of the ski side of transfer region 515. Source 639 selectively provides an AC or DC potential to conductive area 633 to provide a selected electric field for transfer of toner to receiver sheet 42.

Figure 7:
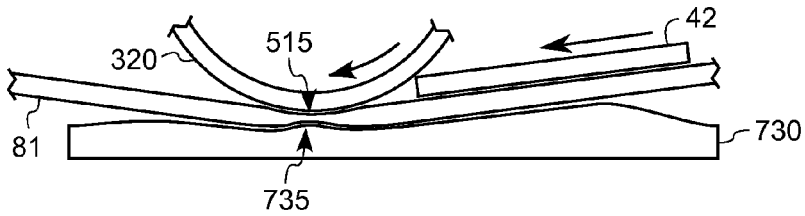

FIG. 7 shows portions of a transfer station according to various embodiments. Image-bearing member 320, transport web 81, receiver sheet 42, and transfer region 515 are as shown in FIG. 5. Nip-forming ski 730 includes protrusion 735 in (e.g., making all or part of one side of) transfer region 515. Protrusion 735 is adapted to locally increase the force between transport web 81 and image-bearing member 320. This can make transfer of toner from image-bearing member 320 to receiver sheet 42 more efficient. Although transport web 81 is shown being compressed by protrusion 735, in various embodiments image-bearing member 320 can also or alternatively be compressed.

Figure 8:
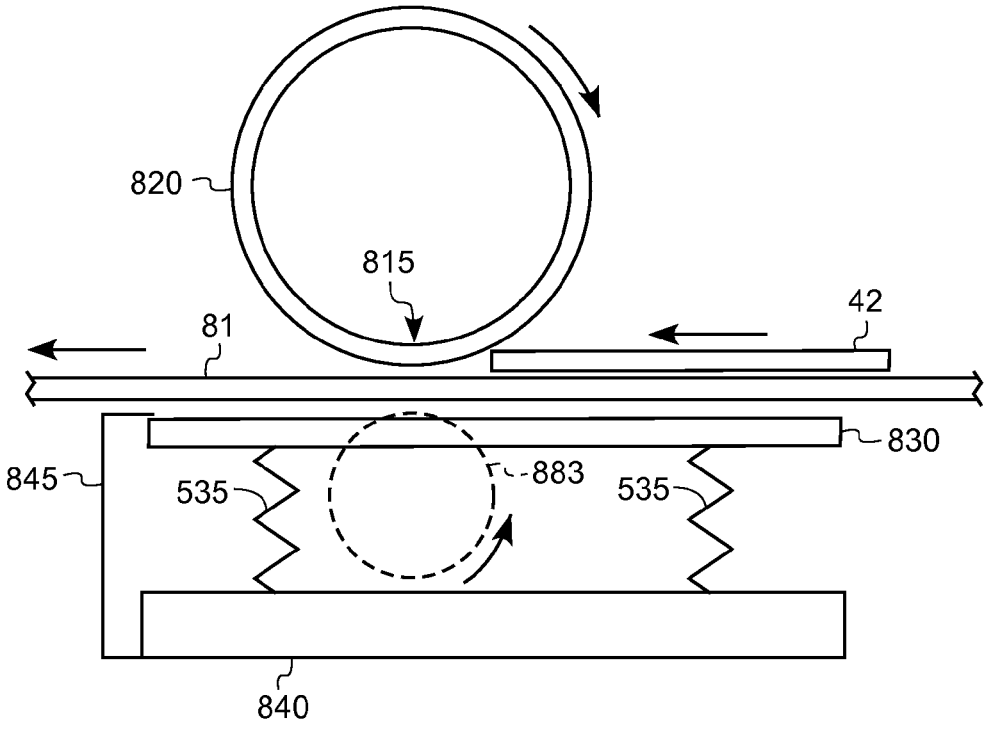

FIG. 8 shows portions of a transfer station according to various embodiments. These embodiments are useful with printers including those in which transport web 81 and image-bearing member 820 are not maintained in contact with each other when the printer is idle. Examples of such printers include those in which image-bearing member 820 is driven by a motor or actuator rather than by frictional contact with transport web 81. The transfer station for an EP printer includes rotatable transport web 81 and rotatable image-bearing member 820 spaced apart from transport web 81, so that a transfer region 815 is defined in which toner is transferred from image-bearing member 820 to receiver sheet 42. In various embodiments, respective drives (not shown) are provided for image-bearing member 820 and transport web 81.

Ski 830 is adjacent to transport web 81 on the opposite side thereof from image-bearing member 820. Ski 830 extends upstream with respect to transport web 81 of transfer region 815. Ski 830 is not always engaged with transport web 81, and selectively forms a nip in transfer region 815, as discussed below.

Ski mount 840 is arranged to cause ski 830 to apply a force not less than zero newtons (ON) on transport web 81 towards image-bearing member 820. This can be done, e.g., using springs 535, or in other ways discussed above. When no receiver sheet is passing through the system, transport web 81 can be experiencing no pressure from ski mount 840, or can be experiencing pressure towards image-bearing member 820. In various embodiments, stop 845 retains ski 830 no closer to image-bearing member 820 than a selected distance. That is, stop 845 prevents ski 830 from moving closer to member 820 than the selected distance.

As receiver sheet 42 moves with transport web 81, receiver sheet 42 engages image-bearing member 820 upstream of transfer region 815. This causes transport web 81 to push against ski 830 to provide a selected nip spacing between image-bearing member 820 and transport web 81 in transfer region 815.

Still referring to FIG. 8, in other embodiments, rotating nip-forming member 883 (e.g., a roller or web) is arranged adjacent to transport web 81 on the opposite side thereof from image-bearing member 820.

Ski 830 is adjacent to transport web 81 on the opposite side thereof from image-bearing member 820 and extends upstream of transfer region 815.

Mount 840 causes nip-forming member 883 to exert a force not less than zero newtons on transport web 81 towards image-bearing member 820. The force can be zero, e.g., when no receiver is passing through transfer region 815. Ski 830 is connected to nip-forming member 883 or mount 840 so that nip-forming member 883 moves away from image-bearing member 820 as the ski does so.

As receiver sheet 42 moves with transport web 81, receiver sheet 42 engages image-bearing member 820 upstream of transfer region 815. Image-bearing member 820 therefore pushes on transport web 81 through receiver sheet 42. Transport web 81 then pushes against ski 830 to move nip-forming member 883 to provide a selected nip spacing between image-bearing member 820 and transport web 81 in transfer region 515.

These embodiments provide smoother displacement of ski 830 or nip-forming member 883 as receiver 42 enters or leaves transfer region 815. This reduces mechanical wave formation and thus the visibility of wave-induced artifacts.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
31, 32, 33, 34, 35, 36 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
111 imaging component
112 transfer component
113 transfer backup component
201 transfer nip
202 second transfer nip
206 photoreceptor
Parts List—Continued
210 charging subsystem
211 meter
212 meter
213 grid
216 surface
220 exposure subsystem
225 development subsystem
226 toning shell
227 magnetic core
240 power source
310 transfer nip
311 displacement
320 image-bearing member
383 nip-forming member
381 point
411 nip spacing
415 transfer region
420 image-bearing member
430 ski
440 mount
483 nip-forming member
515 transfer region
520 compliant layer
530 nip-forming ski
535 spring
540 ski mount
630 nip-forming ski
633 conductive area
636 non-conductive area
639 source
Parts List—Continued
730 nip-forming ski
735 protrusion
815 transfer region
820 image-bearing member
830 ski
840 ski mount
845 stop
883 nip-forming member

The invention claimed is:

1. A transfer station for an EP printer adapted to transfer a toner image to a receiver sheet being carried on a rotatable transport web, the transfer station comprising:

a) the rotatable transport web;

b) a rotatable image-bearing member around which the transport web is at least partially wrapped, so that a transfer region is defined in which toner is transferred from the image-bearing member to the receiver sheet;

c) a nip-forming ski adjacent to the transport web on the opposite side thereof from the image-bearing member and extending upstream of the transfer region; and d) a ski mount arranged to cause the ski to press the transport web towards the image-bearing member;

e) so that as the receiver sheet moves with the transport web, the receiver sheet engages the image-bearing member upstream of the transfer region, causing the transport web to push against the ski to provide a selected nip spacing between the image-bearing member and the transport web in the transfer region.

2. The transfer station according to claim 1, wherein the ski includes a conductive area in the transfer region and a non-conductive area outside the transfer region.

3. The transfer station according to claim 1, wherein the ski includes a protrusion in the transfer region adapted to locally increase the force between the transport web and the image-bearing member.

4. The transfer station according to claim 1, wherein the image-bearing member has a compliant surface of at most 80 Shore A durometer.

5. A transfer station for an EP printer adapted to transfer a toner image to a receiver sheet being carried on a rotatable transport web, the transfer station comprising:

a) the rotatable transport web;

b) a rotatable image-bearing member around which the transport web is at least partially wrapped, so that a transfer region is defined in which toner is transferred from the image-bearing member to the receiver sheet;

c) a rotatable nip-forming member adjacent to the transport web on the opposite side thereof from the image-bearing member;

d) a ski adjacent to the transport web on the opposite side thereof from the image-bearing member and extending upstream of the transfer region; and e) a mount arranged to cause the nip-forming member to press the transport web towards the image-bearing member, wherein the ski is connected to the nip-forming member or the mount so that the nip-forming member moves with the ski;

f) so that as the receiver sheet moves with the transport web, the receiver sheet engages the image-bearing member upstream of the transfer region, causing the transport web to push against the ski to move the nip-forming member to provide a selected nip spacing between the image-bearing member and the transport web in the transfer region.

6. The transfer station according to claim 5, wherein the image-bearing member has a compliant surface of at most 80 Shore A durometer.

7. A transfer station for an EP printer adapted to transfer a toner image to a receiver sheet being carried on a rotatable transport web, the transfer station comprising:

a) the rotatable transport web;

b) a rotatable image-bearing member spaced apart from the transport web, so that a transfer region is defined in which toner is transferred from the image-bearing member to the receiver sheet c) a nip-forming ski adjacent to the transport web on the opposite side thereof from the image-bearing member and extending upstream of the transfer region; and d) a ski mount arranged to cause the ski to apply a force not less than zero newtons on the transport web towards the image-bearing member;

e) so that as the receiver sheet moves with the transport web, the receiver sheet engages the image-bearing member upstream of the transfer region, causing the transport web to push against the ski to provide a selected nip spacing between the image-bearing member and the transport web in the transfer region.

8. The transfer station according to claim 7, further including respective drives for the image-bearing member and transport web.

9. The transfer station according to claim 7, further including a stop adapted to retain the ski no closer to the image-bearing member than a selected distance.

10. A transfer station for an EP printer adapted to transfer a toner image to a receiver sheet being carried on a rotatable transport web, the transfer station comprising:

a) the rotatable transport web;

b) a rotatable image-bearing member spaced apart from the transport web, so that a transfer region is defined in which toner is transferred from the image-bearing member to the receiver sheet;

c) a rotatable nip-forming member adjacent to the transport web on the opposite side thereof from the image-bearing member;

d) a ski adjacent to the transport web on the opposite side thereof from the image-bearing member and extending upstream of the transfer region; and e) a mount arranged to cause the nip-forming member to exert a force not less than zero newtons on the transport web towards the image-bearing member, wherein the ski is connected to the nip-forming member or the mount so that the nip-forming member moves with the ski;

f) so that as the receiver sheet moves with the transport web, the receiver sheet engages the image-bearing member upstream of the transfer region, causing the transport web to push against the ski to move the nip-forming member to provide a selected nip spacing between the image-bearing member and the transport web in the transfer region.

11. The transfer station according to claim 10, further including respective drives for the image-bearing member and transport web.

12. The transfer station according to claim 10, further including a stop adapted to retain the ski no closer to the image-bearing member than a selected distance.

* * * * *